US007904242B2

(12) United States Patent
Tzidon

(10) Patent No.: US 7,904,242 B2
(45) Date of Patent: Mar. 8, 2011

(54) GRID-BASED TRANSMISSION SYSTEM

(75) Inventor: Aviv Tzidon, Tel Aviv (IL)

(73) Assignee: ST Electronics (Training and Simulation Systems) Pte. Ltd., Singapore (SG)

( * ) Notice: Subject to any disclaimer, the term of this patent is extended or adjusted under 35 U.S.C. 154(b) by 1142 days.

(21) Appl. No.: 10/554,877

(22) PCT Filed: Nov. 14, 2003

(86) PCT No.: PCT/SG03/00270

§ 371 (c)(1),
(2), (4) Date: Sep. 8, 2006

(87) PCT Pub. No.: WO2004/097448

PCT Pub. Date: Nov. 11, 2004

(65) Prior Publication Data

US 2007/0073483 A1 Mar. 29, 2007

Related U.S. Application Data

(60) Provisional application No. 60/465,769, filed on Apr. 28, 2003.

(51) Int. Cl.
*G08G 5/04* (2006.01)

(52) U.S. Cl. ..... 701/213; 342/357.34

(58) Field of Classification Search ..... 701/213, 701/300, 215; 342/357.03, 357.09, 357.1, 342/350, 357.2, 357.23–357.28, 357.34
See application file for complete search history.

(56) References Cited

U.S. PATENT DOCUMENTS

| | | | | |
|---|---|---|---|---|
| 5,450,329 | A | 9/1995 | Tanner | |
| 6,718,237 | B1 * | 4/2004 | Murray et al. | 701/24 |
| 2004/0155815 | A1 * | 8/2004 | Muncaster et al. | 342/357.09 |

FOREIGN PATENT DOCUMENTS

| | | |
|---|---|---|
| EP | 0 242 983 | 10/1987 |
| EP | 1 133 115 A2 | 9/2001 |
| WO | WO-95/17685 | 6/2005 |

OTHER PUBLICATIONS

PCT "Written Opinion", Counterpart International Application No. PCT/SG2003/000270, mailed Aug. 19, 2004, 4 pages.
PCT "International Search Report", Counterpart International Application No. PCT/SG2003/000270, mailed Jan. 23, 2004, 3 pages.
PCT "Written Opinion" Counterpart International Application No. PCT/SG2003/000270, mailed Jun. 3, 2004, 4 pages.

* cited by examiner

*Primary Examiner* — Delena Tran
(74) *Attorney, Agent, or Firm* — Blakely Sokoloff Taylor & Zafman LLP

(57) ABSTRACT

A grid-based transmission system for determining relative positions of vehicles in a grid quadrangle of a reference grid, each vehicle having a transmitter and a receiver, comprising determining an absolute position of a vehicle. A reference grid is obtained. A reference point for the reference grid is assigned; and a relative position of the vehicle relative to the reference point is generated. The reference grid is a stored and previously generated reference grid, or is generated based on the absolute position and a transmission range of a transmitter. The vehicle sends a position message containing the relative position; the transmission range; an identity of the vehicle; an identity for all other vehicles that have previously sent a position message received by the vehicle; and the relative position of the all other vehicles.

27 Claims, 4 Drawing Sheets

GRID-BASED TRANSMISSION SYSTEM

CROSS-REFERENCE TO OTHER APPLICATIONS

This is a National Phase of International Application No. PCT/SG2003/000270, filed on Nov. 14, 2003, which claims priority from U.S. Provisional Patent Application No. 60/465,769, filed on Apr. 28, 2003.

FIELD OF INVENTION

The invention relates to a grid-based transmission system and refers particularly, though not exclusively, to such a system to enable efficient sending and receiving of position messages for determining absolute positions of vehicles in a space.

BACKGROUND

All applications for location-based communication, command and control systems use information based on an X, Y-axis reference. When a network of moving members is involved, information has to be frequently updated. Depending on network's requirements for resolution and accuracy, the information may become a major part of the size of the message frame. Where the system requires world-wide operability, the size of the X-Y information in a one-meter resolution is, for example, greater than 52 bits (26 bits for X and 26 bits for Y), to cover 40,000 Km.

If the range of the communication is three or more orders of magnitude smaller, the receiving of a transmission allows one to assume the position of the transmitting member. Some world-wide networks limit by regulation the maximum allowed transmitter output power.

SUMMARY OF THE INVENTION

According to a preferred aspect of the present invention there is provided a grid-based transmission system for determining relative positions of vehicles in a grid quadrangle of a reference grid, each vehicle having a transmitter and a receiver, comprising the steps:

(a) determining an absolute position of a vehicle;
(b) obtaining the reference grid;
(c) assigning a reference point for the grid quadrangle; and
(d) generating a relative position of the vehicle relative to the reference point.

The reference grid may be obtained by being generated, or by retrieving a stored and previously generated reference grid. Also, the reference grid may be based on the transmission range of the vehicle's transmitter or from the identity of the vehicle's transmitter. The transmission range may be obtained from a specification of the transmitter, and the reference point may be an agreed reference point, or a reference point generated by an agreed methodology.

There may be included a further step of the vehicle sending a position message containing the relative position. The position message may also contain one or more of the transmission range; an identity of the vehicle; an identity for all other vehicles that have previously sent a position message that was received by the vehicle; and the relative position of the all other vehicles. A position message previously sent and/or received may be at any previous time and in particular may be within a pre-determined number of transmission cycles.

Alternatively or additionally, there may be included an additional step of receiving from a second vehicle a position message containing a relative position of the second vehicle. The position message may also contain the identity or transmission range of the transmitter of the second vehicle, and an identity of the second vehicle. The reference grid may be generated based on the identity or transmission range of the transmitter of the second vehicle.

The reference grid may be generated according to the absolute position to allow for different grid systems in different areas of the globe. That will provide a way to eliminate the problem of the longitude and latitude lines becoming closer as one approaches the north and south poles area making the quadrangle not a square, and potentially making the quadrangle smaller than the maximum range. Preferably, the quadrangle approximates a square.

In a further preferred form, the present invention also provides a method for determining relative position of vehicles in a grid quadrangle of a reference grid, all vehicles having a transmitter and receiver, the method comprising the steps:

(a) a first vehicle determining its absolute position;
(b) the first vehicle obtaining the reference grid;
(c) assigning a reference point to the reference grid;
(d) the first vehicle generating a relative position of the first vehicle relative to the reference point; and
(e) the first vehicle sending a position message containing the relative position.

In a penultimate preferred form the present invention provides a method for determining relative positions of vehicles in a grid quadrangle of a reference grid, all vehicles having a transmitter and a receiver, the method comprising the steps:

(a) a second vehicle receiving a position message from a first vehicle;
(b) the second vehicle obtaining the reference grid;
(c) the second vehicle determining its absolute position; and
(d) the second vehicle determining the first vehicle reference point to the reference grid.

The reference point of the second vehicle is determined by the second vehicle, and is preferably selected from an agreed reference point, and a reference point generated by an agreed methodology. The first vehicle determines its reference point, the reference point of the first vehicle being the same as or different to the reference point of the second vehicle. The second vehicle may generate a relative position of the second vehicle relative to its reference point.

The reference grid may be obtained by being generated, or by retrieving a stored and previously generated reference grid. The reference grid may be generated by using the identity of the transmitter of the first vehicle or a maximum transmitting range of the transmitter of the first vehicle.

For all forms, the absolute position may be obtained by using a GPS. Also, the grid quadrangle may have a size greater than the maximum transmitting range. Preferably, the reference grid has a quadrangle size at least twice the maximum transmitting range.

The position message may also contain an identity of the first vehicle, and at least one of, the maximum transmission range of the transmitter of the first vehicle, and an identity of the transmitter of the first vehicle: and the reference grid is generated based on at least one of the transmission range of the transmitter of the first vehicle, and an identity of: the transmitter of the first vehicle.

The position message may also contains an identity of all other vehicles that have previously sent a position message that was received by the first vehicle, and the relative position of the all other vehicles; as received by the first vehicle in a predetermined number of previous transmission cycles.

The assigning of the reference point may be dynamic.

For all forms, the second vehicle may use the relative position of the first vehicle, the maximum transmission range, and the absolute position of the second vehicle to determine the absolute position of the first vehicle.

In a final preferred form, the present invention provides a computer usable medium comprising computer program code that is configured to cause a processor to execute one or more functions to perform the method described above.

BRIEF DESCRIPTION OF THE DRAWINGS

In order that the present invention can be readily understood and put into practical effect, there shall now be described by way of non-limitative example preferred embodiments of the present invention, the description being with reference to the accompanying illustrative drawings in which.

DETAILED DESCRIPTION OF THE PREFERRED EMBODIMENTS

The present invention is useable over a large area. The space may be global, or regional. If regional, it may be for a country (for aircraft), an ocean (for ships), or a smaller area such as a city or state for land vehicles. It may be used for vehicles such as, for example, aircraft, ships, and land vehicles requiring communication between them of their relative positions. Such land vehicles may include military vehicles, large trucks, fire trucks, railway locomotives, or the like.

The following exemplifying description is for aircraft on a global grid. In the network there may be a large number of aircraft. Present systems rely on aircraft position information in latitude and longitude for each member in the network being broadcast to all members of the network. According to a preferred aspect of the present invention, only a relative position of each member is transmitted to members within the network. The absolute position of each member can be obtained from the following information:

pre-defined globe-wide grid of reference points;

the members own absolute position; and received relative position of other members.

If a member receives the message, then the member must be within the transmission range of the sender.

Using the known maximum range of a members transmitter, it is possible to divide the globe into a variable-size grid. Each member can send their position relative to an agreed grid and assigned reference point. The network member receiving the position message is able to determine the position of the vehicle transmitting the position message by determining the grid reference point and adding, to it the offset position.

Figure 1:
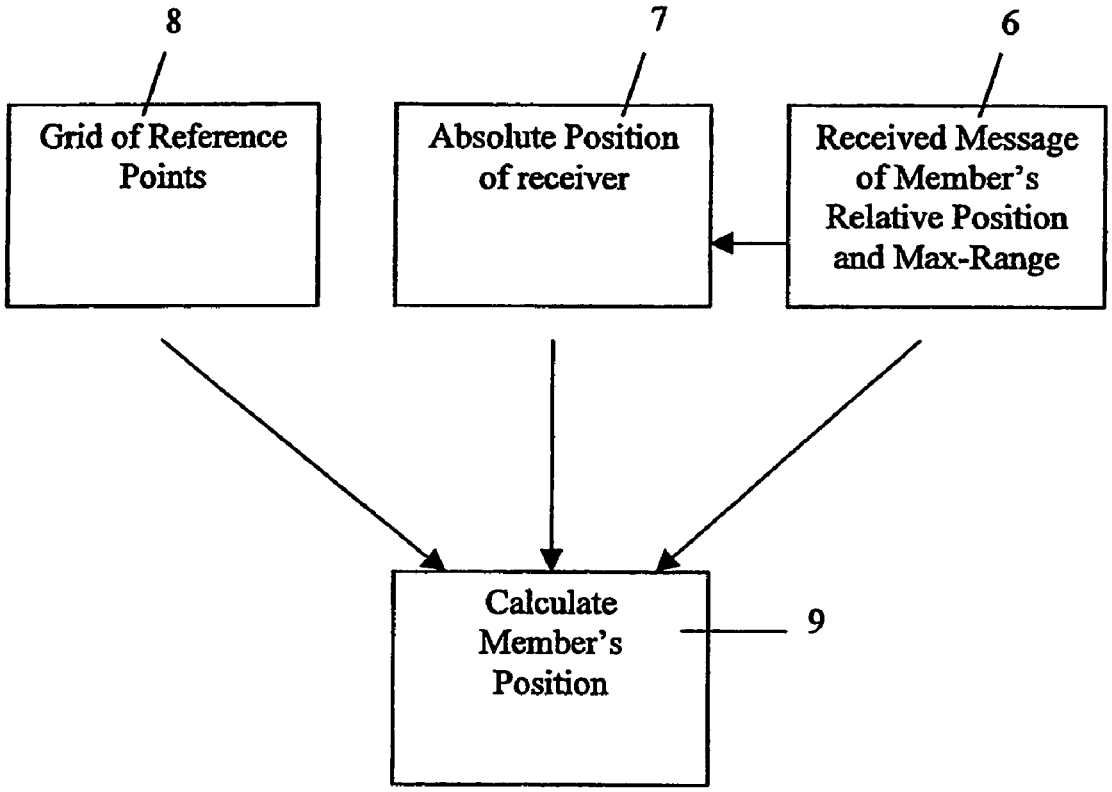
FIG. 1 is an illustration of the methodology for determining network members positions using one aspect of the present invention.
Figure 2:
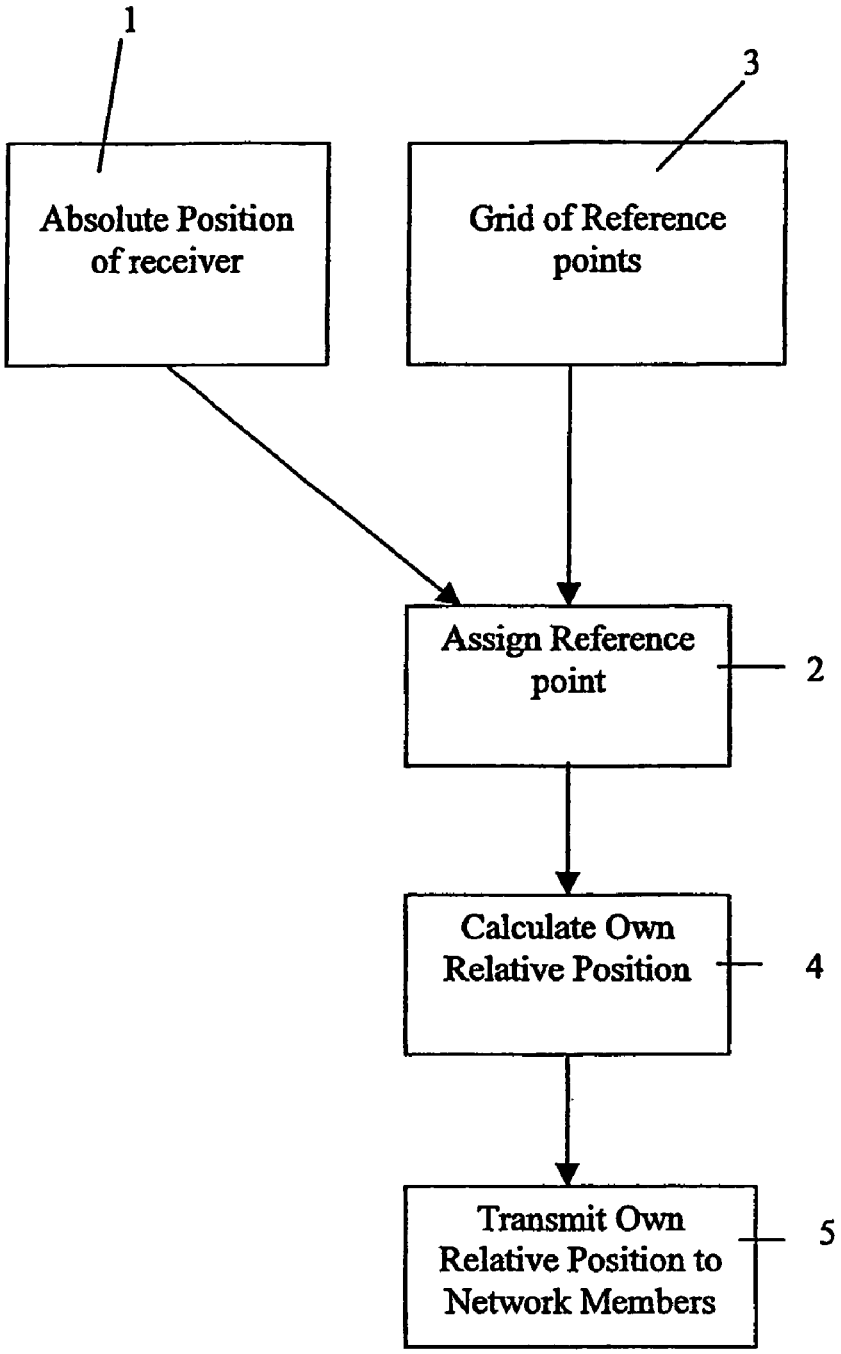
FIG. 2 is a flow chart for the methodology of a member calculating their own position according to a preferred aspect of the present invention.

With reference to FIGS. 1 and 2, to keep the network distributed each member of the network will:

When transmitting (FIG. 2):

1. Acquire their absolute position (step 1)

With common GPS technology (or its equivalent) each member can acquire the member's absolute location in latitude and longitude.

2. Assign a reference point (step 2)

With their absolute location from step 1 and the member's transmitter's maximum range as inputs, the appropriate reference grid is generated. The reference grid can be generated based on one of: the transmitter range, the transmitter identity, or may be a previously used and stored reference grid. In the last case, a code for the grid is preferably included in the transmission.

In step 3, the grid quadrangle in which the member is positioned is determined. The reference point for the grid quadrangle is assigned to the grid. The assigning of the reference point may be dynamic, and the methodology or calculation of the assigning of the grid reference point may be agreed. The reference point may be any reference point in the grid such as, for example, lower left, south west, top right, north east, top left, north west, lower right, south east and so forth. The member's transmitter's maximum range may be obtained from the transmitter's specifications. It is preferably pre-programmed into the vehicles'on-board computer. Alternatively, it may be set by regulation, by a standard, by a protocol, or by a convention or agreement. The vehicles may store transmission ranges of transmitters so that all that needs be transmitted is the identity of the transmitter. The receiving vehicle can easily determine the range of the transmitter from the stored data.

The reference grid may be generated according to the absolute position to allow for different grid systems in different areas of the globe. That will provide a way to eliminate the problem of the longitude and latitude lines becoming closer as one approaches the north and south poles area making the quadrangle not a square, and potentially making the quadrangle smaller than the maximum range. Preferably, the quadrangle approximates a square. It may be a rectangle. The quadrangle may be regular, or irregular. At least one of the lines of the quadrangle may not be straight The size and/or shape of the quadrangle may vary according to latitude and/or longitude.

3. Calculate relative position (step 4)

The member's relative latitude and longitude position relative to the assigned reference point is then calculated.

4. Transmit relative position (step 5)

Each member can transmit their relative position to all network members in a position message. The transmitted position message should contain:

(i) the member's identity, and (ii) the member's relative position.

Where the reference grid is a predetermined grid this information is sufficient.

If the network of members in the reference grid includes transmitters of more than one type and/or range, the data transmitted should include more data to enable generation of the reference grid. The extra data included may comprise, for example:

(i) the maximum range of the member's transmitter, and (ii) a grid code to help selecting the reference grid from a predetermined list of reference grids.

The maximum transmitter range may be set by regulation, a standard, a protocol, a convention, or agreement.

Receiving (FIG. 1)

1. Receive relative positions (step 6)

Receive a position message from another network member ("sending member") and recognize the maximum range of the transmitter of the sending member.

2. Acquire absolute position (step 7)

With generally available GPS technology (or its equivalent), the receiver determines its absolute location in latitude and longitude.

3. Obtain reference grid (step 8)

Using the maximum range of the sending member's transmitter as transmitted in the position message, obtain the appropriate reference grid by either being generated, or by retrieving a stored and previously generated reference grid. The reference grid can be determined at the discretion of the receiver.

4. Calculate the transmitter's absolute position (step 9)

The receiver determines the grid reference point and calculates the transmitter's absolute position.

The receiver is then in the position of being able to send it to all other members in the network during the receiver's next transmission cycle.

For each relative position there may be a different reference point. The sending vehicle will have its reference point The receiving vehicle may share the same reference point. This may happen if the two vehicles are in the same quadrangle in the reference grid, but not necessarily. If the two vehicles are in different quadrangles of the reference grid, the reference points will be different if the same methodology for allocating a reference point is used.

Therefore, the receiver knows the absolute position of the sender.

The receiver can then send its position message in its next transmission cycle. The transmission message will also contain information of the position of the sending vehicle. As communication between vehicles will be ongoing, the information of the position of the sending vehicle may be limited to such information received in a predetermined number of transmission cycles so that the information is still relevant. The predetermined number of will vary according to the nature of the vehicles. For relatively fast vehicles, the predetermined number will be relatively low, but for relatively slow vehicles, the predetermined number may be quite large.

The reference grid is constructed in such a way that for each position message received there will be only one reference point to which the relative position can refer knowing the receiver location. This quality can be achieved by using a grid that is two times larger than the range of the transmitters. Therefore calculating any received message will give a singular result.

Figure 3:
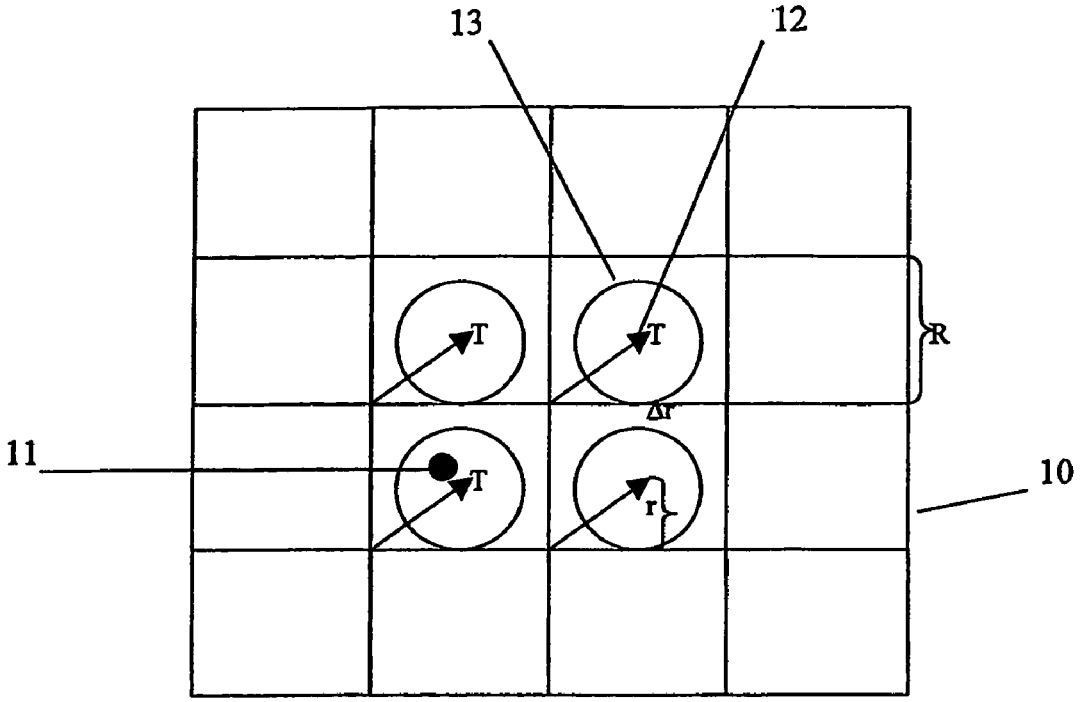
FIG. 3 is and illustration of a receiver being within transmitter range.
Figure 4:
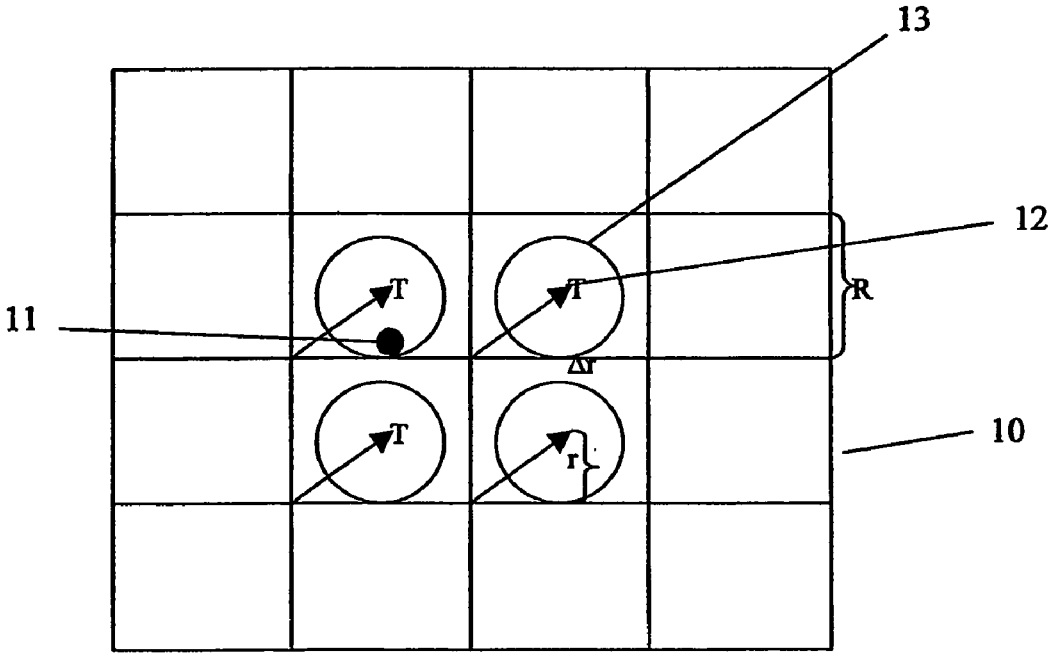
FIG. 4 is, a further illustration of a receiver being within transmitter range.
Figure 5:
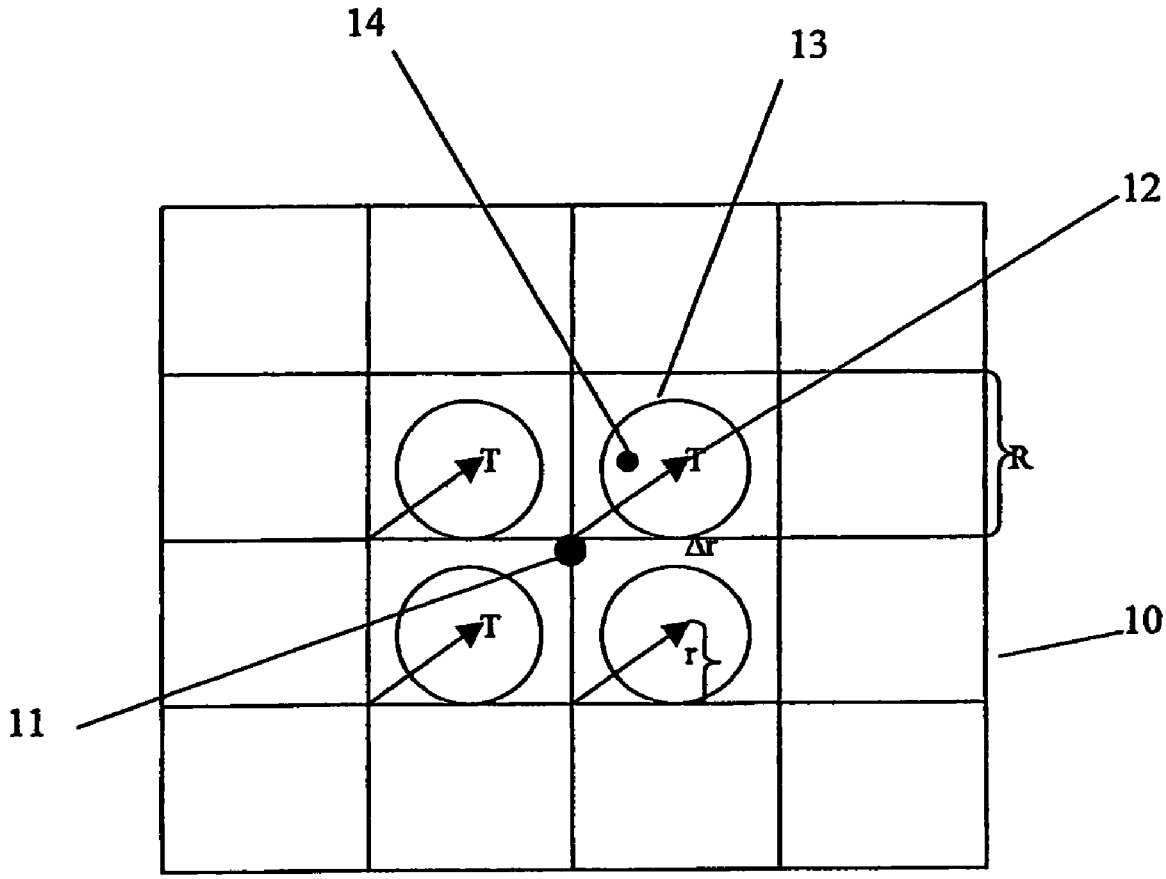
FIG. 5 is an illustration of a receiver being outside transmitter range.

To refer now to FIGS. 3 to 5, one example of a grid structure 10 is shown. The receiver is shown by the large dot 11. The transmitter is at T—but can not be the centre 12 of circle 13. The circle 13 represents the maximum range of the transmitter of the transmitting vehicle T therefore the only T that can be the sender is the centre 15 of circle 16. Note that the position data is relative to the lower left corner and the transmitter T location can be in any of the Ts' instances. Therefore, the actual position T is determined by the location of receiver 11. The radius of the circle is the maximum range and is designated r. The difference between the total maximum range (i.e. the diameter of circle 13) and the size of each quadrangle R of grid 10 is Δr. Therefore, $$R=2\times r+\Delta r$$

where Δr is an agreed safety margin. Preferably, it is agreed upon at a practical level and may vary according to many factors such as, for example, the nature of the vehicles, where they are, and so forth. It should be considered as a constant during operation of the system. It may be, for example, 10%.

This allows transmitting smaller position messages, without reducing the required network accuracy. The shorter the maximum range of the network, the better optimization will be accomplished. For example a network with 4000-meter transmitter range will be half the size (26 bit Vs 52 bit) of a network with a 8000-meter range.

The reference grid has a quadrangle size that is greater than, and preferably at least twice, the maximum transmitting range.

FIG. 5 illustrates when member 11 is outside the transmission range of T's transmitter and therefore will not receive the position message. However, by this stage the member 11 is in a different grid quadrangle, but does bring with it the previous contact details of aircraft in previous communication cycles.

Consider an example of a global network for collision avoidance of marine vessels. This network may use 2.4 GHz low power transmitters within the limitation of FCC part 15A. The range that such an application requires has to be within the response time when a warning of a possible future collision arises. One-minute warning is sufficient to change the direction of a ship and to create enough clearance between the two vessels. The range that vessels can travel in one minute is less than 2 Km, so a network with a maximum range of 2 Km allows the globe to be divided into a grid having 4-Km quadrangles. Each participant can transmit their global position with a 26-bit position message.

The present invention also provides a computer usable medium comprising computer program code that is configured to cause a processor to execute one or more functions to perform the method described above.

Preferably, all transmissions and receptions may be automatic. An on-board computer for each vehicle can perform all necessary computations. Preferably, the on-board computer is directly linked to the transmitter and receiver to enable full digital transmission and reception. Transmission and reception may be in accordance with TDMA or CDMA standards and protocols. The vehicle may have a display for indicating the relative positions of all vehicles within the quadrangle of the grid or transmission range.

The communication channel may have either or both of small position messages and more detailed position messages. The more detailed position messages may contain different levels of detail, but all the position messages should contain the detail of the small position messages—the relative position of the sending vehicle. This may be applicable to all levels of the messages, and messages having all or some of the different levels of detail may appear in a communication session.

Whilst there has been described in the foregoing description a preferred embodiment of the present invention, it will be understood by those skilled in the technology that many variations or modification in details of design, construction or operation may be made without departing from the present invention.

What is claimed is:

1. A grid-based transmission system for determining relative positions of vehicles from their absolute positions in a quadrangle of a reference grid, each vehicle having a transmitter and a receiver, comprising:

an on-board computer to a) determine an absolute position of a first vehicle;

b) obtain the reference grid with a quadrangle size greater than a maximum transmitting range of a transmitter for the first vehicle;

c) assign a reference point in the reference grid;

d) generate a relative position of the first vehicle relative to the reference point; and e) send a position message containing the relative position and the maximum transmission range of the first vehicle's transmitter.

2. A system as claimed in claim 1, wherein the reference grid is obtained by retrieving a stored and previously generated reference grid.

3. A system as claimed in claim 1 wherein the absolute position is obtained by using a Global Positioning System ("GPS").

4. A system as claimed in claim 1, wherein the reference grid has a quadrangle size at least twice the maximum transmitting range.

5. A system as claimed in claim 1, wherein the reference point is selected from the group consisting of: an agreed reference point, and the reference point as generated by an agreed methodology.

6. A system as claimed in claim 1, wherein the reference grid is generated based on at least one selected from the group consisting of: the transmission range of the transmitter of a second vehicle, and the identity of the transmitter of the second vehicle.

7. A system as claimed in claim 6, wherein the maximum transmission range is obtained from a specification of the transmitter.

8. A system as claimed in claim 6, wherein the on-board computer further:

f) receives from the second vehicle a position message containing a relative position of the second vehicle, the first vehicle using the relative position of the second vehicle, the maximum transmission range, and the absolute position of the first vehicle to determine the absolute position of the second vehicle.

9. A system as claimed in claim 8, wherein the position message from the second vehicle also contains the transmission range of the transmitter of the second vehicle and an identity of the second vehicle, and the reference grid is generated based on at least one selected from the group consisting of: the transmission range of the transmitter of the second vehicle, and an identity of the transmitter of the second vehicle.

10. A system as claimed in claim 1, wherein the position message also contains an identity of the first vehicle.

11. A system as claimed in claim 10, wherein the position message also contains an identity of all other vehicles that have previously sent a position message that was received by the first vehicle, and the relative position of the all other vehicles, as received by the first vehicle in a predetermined number of previous transmission cycles.

12. A system as claimed in claim 10, wherein the position message is receivable by a second vehicle, the second vehicle using the relative position of the first vehicle, the maximum transmission range, and the absolute position of the second vehicle to determine the absolute position of the first vehicle.

13. A method for determining relative position of vehicles from their absolute positions in a quadrangle of a reference grid, all vehicles having transmitters and receivers, the method comprising:

a) a first vehicle determining its absolute position;

b) the first vehicle obtaining the reference grid with a quadrangle size greater than a maximum transmitting range of a transmitter for the first vehicle;

c) the first vehicle assigning its reference point to the reference grid;

d) the first vehicle generating a relative position of the first vehicle relative to its reference point; and e) the first vehicle sending a position message containing the relative position and the maximum transmission range of the first vehicle's transmitter.

14. A method as claimed in claim 13, wherein the reference point is selected from the group consisting of an agreed reference point, and a reference point generated by an agreed methodology.

15. A method as claimed in claim 13, wherein the position message contains an identity of the transmitter of the second vehicle.

16. A method as claimed in claim 15, wherein the reference grid is obtained by being generated based on at least one selected from the group consisting of:

the transmission range of the transmitter of the second vehicle, and the identity of the transmitter of the second vehicle.

17. A method as claimed in claim 15, wherein the maximum transmission range is obtained from a specification of the transmitter.

18. A method as claimed in claim 13, wherein the reference point is selected from the group consisting of an agreed reference point, and a reference point generated by an agreed methodology.

19. A method as claimed in claim 13, wherein the absolute position is obtained by using GPS.

20. A method as claimed in claim 13, wherein the size of the grid quadrangle is at least twice the maximum transmission range.

21. A method as claimed in claim 13, wherein the position message also contains an identity of the first vehicle.

22. A method as claimed in claim 13, wherein the position message also contains an identity of all other vehicles that have previously sent a position message that was received by the first vehicle, and the relative position of the all other vehicles; as received by the first vehicle in a predetermined number of previous transmission cycles.

23. A method as claimed in claim 13, wherein the assigning of the reference point is dynamic.

24. A method as claimed in claim 13, wherein the quadrangle is selected from the group consisting of: regular quadrangle, irregular quadrangle, rectangle, and square.

25. A method as claimed in claim 24, wherein the quadrangle has at least one side that is not straight.

26. A method as claimed in claim 24, wherein at least one of the size and shape of the quadrangle varies according at least one of the latitude and longitude.

27. A computer readable storage medium storing computer program code that is configured to cause a processor to execute one or more functions to perform a method for determining relative positions of vehicles from their absolute positions in a quadrangle of a reference grid comprising:

determining an absolute position of a first vehicle;

obtaining a reference grid with a quadrangle size greater than a maximum transmitting range of a transmitter for the first vehicle;

assigning a reference point to the reference grid;

generating a relative position of the first vehicle relative to the reference point; and sending a position message containing the relative position and the maximum transmission range of the first vehicle's transmitter.

* * * * *